United States Patent [19]

Rummel et al.

[11] 4,146,078

[45] Mar. 27, 1979

[54] METHOD OF AND APPARATUS FOR CONTINUOUS HORIZONTAL CASTING

[75] Inventors: Theodor Rummel, Hanover, Fed. Rep. of Germany; Wilfried Heinemann, Richterswil, Switzerland

[73] Assignee: Concast AG, Zurich, Switzerland

[21] Appl. No.: 862,051

[22] Filed: Dec. 19, 1977

[30] Foreign Application Priority Data

Dec. 17, 1976 [CH] Switzerland ..... 15883/76

[51] Int. Cl.[2] ..... B22D 27/02; B22D 11/12

[52] U.S. Cl. ..... 164/49; 164/147

[58] Field of Search ..... 164/48, 49, 146, 147, 164/148, 440, 250, 251

[56] References Cited

U.S. PATENT DOCUMENTS 4,082,207 4/1978 Garnier et al. ..... 164/147

FOREIGN PATENT DOCUMENTS 1558224 4/1973 Fed. Rep. of Germany ..... 164/49

*Primary Examiner*—Richard B. Lazarus
*Assistant Examiner*—K. Y. Lin
*Attorney, Agent, or Firm*—Tobias Lewenstein

[57] ABSTRACT

An apparatus for continuous horizontal casting has a vessel for holding the molten metal to be cast. The vessel has an opening in its side which is arranged so that a stream of molten metal issuing therefrom enters a horizontal path. The stream is maintained in a molten state in the upstream end portion of the path and is cooled in an adjacent downstream portion of the path. A mechanism is provided for continuously drawing the strand formed from the stream of molten metal along the path. During the initial stages of solidification, the strand consists of a thin shell of solidified metal surrounding a molten core. The strand tends to sag here and an arrangement is provided for counteracting the weight of the strand. This arrangement includes a connected pair of electrical contacts one of which is immersed in the body of molten metal and the other of which contacts the strand. The arrangement further includes magnets which generate a horizontal magnetic field extending normal to the axis of the strand. The interaction of the magnetic field and the electrical current along the strand causes an upwardly directed force to be exerted on the strand. Another arrangement is provided for counteracting the metallostatic pressure due to the body of molten metal in the vessel. This arrangement includes coils which surround the path and are arranged to generate an alternating magnetic field around the strand.

13 Claims, 5 Drawing Figures

METHOD OF AND APPARATUS FOR CONTINUOUS HORIZONTAL CASTING

The invention relates to a continuous horizontal casting process in which molten metal is drawn from an opening in the side of a container and the strand formed from the molten metal is cooled. Before the strand is completely solidified, an electrical current is passed through it in longitudinal direction thereof and a horizontal magnetic field is set up at right angles to the longitudinal axis thereof so as to substantially offset the weight of the strand. The invention also relates to apparatus for carrying out this process.

With horizontally arranged continuous casting molds, difficulties arise that are additional to those encountered with vertically arranged continuous casting molds. The reason is that, as a result of gravity, the still soft shell of the strand is essentially supported only on the lower half of the mold. Thus, cooling of the strand is unsatisfactory since it is intense within the lower half of the mold but not so in the upper half due to the formation of an air gap in the upper half. This results in distortion of the strand and in an undesired, non-uniform structure therein.

Furthermore, oscillation of the mold in continuous horizontal casting constitutes a problem that has not been satisfactorily solved. Between the pouring spout and the mold, which are movable relative to one another, there is a zone of contact which requires a seal. The high temperature, the thermal expansion of the pouring spout and the possibility of molten metal entering the sealing zone make it difficult to provide a seal which would stand up. Therefore, it has been proposed to dispense with oscillation of the mold. In the absence of oscillation, the mold is firmly connected to the pouring spout. Lubricants, inert gases, etc. have been used here to prevent the strand from adhering to the wall of the mold.

A further general problem associated with continuous horizontal casting is backward cooling and the resulting solidification of metal in the pouring spout. This phenomenon is due to the dissipation of heat from the adjacent cooled mold. The presence of metal crusts in the pouring spout can lead to interruptions in the casting operation and to defects in the strand.

A horizontal continuous casting installation is known which attempts to prevent collapse of the upper surface of the strand by increasing the metallostatic pressure in the partially solidified strand to such an extent that the upper surface of the strand is adequately supported from within. The metallostatic pressure is here controlled by the action of electromagnetic forces applied to the still molten core of the strand in axial direction of the latter. This installation likewise has a non-oscillating mold. To prevent the shell of the strand from adhering to the wall of the mold, lubricant is injected into the gap between the pouring spout and the cooled mold. However, the introduction of lubricant in this manner is likely to cause trouble since any change in the pressure and/or viscosity of the molten metal requires a change in the pressure conditions for injection of the lubricant. The parameters affecting the pressure conditions for injection of the lubricant cannot be determined or can be determined only with great difficulty.

It is also known to offset the weight of a horizontal steel strand following its emergence from the mold so as to prevent deformation of the still soft shell of the strand by the dead weight of the strand. In this method, the weight of the strand is offset by generating a direct or alternating current in the strand and simultaneously exposing the strand to a constant or alternating horizontal magnetic field which extends at right angles to the strand. The current preferably flows in longitudinal direction of the strand. In accordance with the three-finger rule, the molten metal and the shell of the strand are subjected to upwardly directed forces when the polarities of the current and the magnetic field have the proper relationship. This method uses a non-oscillating mold which directly adjoins the pouring spout of a molten metal container. However, the effect of the metallostatic pressure is not taken into account. This pressure is capable of scattering droplets from a stream of molten metal drawn from the container and/or of causing a thin strand shell to bulge. In addition, the above-mentioned problems associated with non-oscillating molds and lubrication of the strand, as well as the problems of backward cooling and uneven cooling of the upper and lower faces of the strand within the mold, are not solved by the method of compensating for the weight of the strand outside of the mold.

It is an object of the present invention to at least partially eliminate the foregoing problems and disadvantages of continuous horizontal casting, and to establish a novel concept for continuous horizontal casting which envisions the use of intangible means for supporting the strand and for ensuring the cohesion thereof.

According to the invention, this object is achieved in that an alternating magnetic field is induced in the molten metal in such a manner as to surround the same. The alternating magnetic field is induced in a sub-zone of a zone where the weight of the strand is to be offset. This sub-zone follows the pouring spout or opening. The metallostatic pressure in the strand is substantially offset by appropriately regulating the strength of the alternating magnetic field.

The apparatus in accordance with the invention is characterized in that a coil which is capable of producing an alternating magnetic field is arranged at a position immediately following the lateral pouring opening and surrounds the cross-section of the latter.

The induced alternating magnetic field produces inwardly directed forces in the strand which cause the molten metal and partially solidified strand to cohere without the use of tangible means. At the same time, the weight of the strand is offset so that at least a sub-zone adjacent to the pouring spout can be bridged in "floating" fashion, that is, without the use of tangible means for supporting and containing the strand. Due to the presence of this "floating" sub-zone, the pouring opening or spout of the molten metal container is no longer in contact with a mold and the above-mentioned problems of backward cooling and of providing a seal between the mold and the pouring spout no longer occur. Also, the molten metal and partially solidified strand are able to move horizontally while retaining a predetermined shape.

In accordance with a further feature of the invention, the strand is also cooled in the sub-zone and a self-supporting shell is formed thereon. To this end, long coils, or a plurality of coils and cooling devices, are arranged one behind the other in the direction of movement of the strand. It then becomes possible to use fewer supporting rollers, or even to dispense with a mold and supporting rollers altogether. This results in an improved surface due to the reduction in or elimination of friction. Furthermore, the soft shell of the strand is not continuously subjected to alternating tensile and compressive loads by the supporting rollers when these are eliminated. In addition, uniform cooling is more readily achieved in the absence of a mold and without hindrance by supporting rollers.

Another object of the invention is to provide for improved oscillation of a mold in continuous horizontal casting. In accordance with a further feature of the invention, such improvement can be achieved by cooling the molten metal in an oscillating mold adjacent to the sub-zone and forming the partially solidified strand in this mold. Due to the fact that the weight of the strand and the metallostatic pressure are offset, the strand enters the mold concentrically so that uniform cooling becomes possible. This promotes a homogeneous structure and counteracts distortion. The problems associated with the provision of a seal between the mold and the pouring spout and with adherence of the strand to the mold wall do not arise with this embodiment of the invention.

Since a space exists between the pouring spout and an oscillating mold in accordance with the invention, a lubricant or casting powder can be introduced between the molten metal stream and the mold wall. To this end, a device for supplying lubricant or casting powder may be provided upstream of the mold. In this manner, the forces applied to the partially solidified strand for withdrawing the same from the mold may be kept small. Furthermore, an improved strand surface can be obtained.

The invention will now be described in greater detail with reference to the embodiments illustrated in the attached drawing in which.

Figure 1:
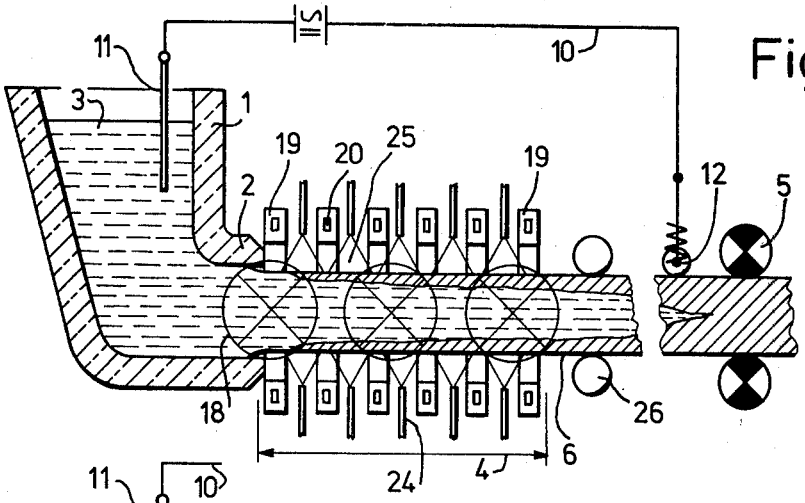
FIG. 1 is a longitudinal section through an embodiment of the invention which operates without a mold.

FIG. 1 shows a container 1 which is filled with molten metal 3 and has a lateral pouring outlet or opening 2 in the lower part thereof. Adjacent to this pouring opening 2 there is a sub-zone 4 having an arrangement for supporting a continuously cast metal strand via intangible means. This arrangement includes a unit for offsetting the weight of the strand and a unit for offsetting the metallostatic pressure due to the molten metal 3. The unit for offsetting the weight of the strand includes an alternating-current or direct current circuit 10 having a submerged electrode 11 and a current pick-up 12. The circuit 10 is completed by the molten metal 3 and a strand 6 that is being formed. The unit for offsetting the weight of the strand 6 further includes coils or magnets for generating constant or alternating horizontal magnetic fields 18 which extend at right angles to the longitudinal axis of the strand 6. These fields 18, which begin at the pouring opening 2, pass through the strand 6 and the plane of the drawing. Thus, in accordance with the three-finger rule, upwardly directed forces are produced when the polarities of the magnetic fields 18 and the current in the circuit 10 are properly adjusted. These forces, which may be regulated, counteract the weight of the strand 6. The magnitudes and directions of these compensating forces are determined by the vector product of the current density and the magnetic induction. If the phase of one of these two parameters is incorrect, the forces might be downwardly directed thereby increasing the effective weight of the strand 6. By now reversing the polarity of the current or the magnetic field, the directions of the forces will be reversed and they will act as compensating forces.

The metallostatic force is substantially offset by means of coils 19 which surround the strand 6 and which induce alternating electromagnetic fields in the latter. These fields result in radially inwardly directed forces which, when integrated along a direction from the exterior of the strand 6 to the interior thereof, yield a pressure which is exerted radially of the strand 6 and has the effect of counteracting the metallostatic pressure. This electromagnetically generated counterpressure can be regulated by appropriate selection of the frequency and strength of the alternating current in the coils 19. The pressure increases with the square of the current and is inversely proportional to the square root of the frequency when the power loss induced in the strand 6 is constant. The effective range of this counterpressure preferably encompasses at least that portion of the range in which the weight of the strand 6 is compensated and where the shell of the strand 6 is being formed or is not sufficiently capable of supporting a load. It is known that increasing frequency decreases the shell thickness which is influenced by the magnetic field and within which the main build-up of the counterpressure occurs. A plurality of the coils 19 are arranged one after the other in the zone 4 where no carrier or supporting rollers are provided. The cross-section of the pouring opening 2 corresponds approximately to the desired cross-section of the strand 6 and may be of any required shape. The cross-section of the space surrounded by each coil 19 has roughly the same shape as the desired cross-section of the strand 6 but is somewhat larger than this desired cross-section.

The surfaces of the coils 19 are covered with an insulating layer of ceramic material, enamel etc. The coils 19 are further provided with cooling ducts 20. Cooling devices in the form of spray nozzles 24 are provided between the coils 19 and accelerate formation of the shell of the strand 6. The fan-like jets 25 issuing from the nozzles 24 form a continuous cooling zone. However, in order to prevent backward cooling, it is important that the pouring opening 2 not be cooled by the fan-like jets 25. The use of lubricants is unnecessary in this arrangement. It will be understood that multi-layer coil arrangements could be used in this embodiment of the invention.

Supporting rollers 26 can be arranged downstream of the zone 4 where the strand 6 is supported via intangible means. Driven rollers 5 are used to move the strand 6 and the starter bar used at the start of the casting operation.

When casting is to be commenced, a rigid, non-illustrated starter bar is moved towards the pouring opening 2 by means of the driven rollers 5 and the pouring opening 2 is closed by the head of the starter bar. Non-illustrated rollers are provided for supporting the starter bar while it is being moved towards and away from the pouring opening 2. These rollers are swung away after the strand 6 has begun to form. When casting begins, the circuit 10 is closed via the starter bar.

Figure 2:
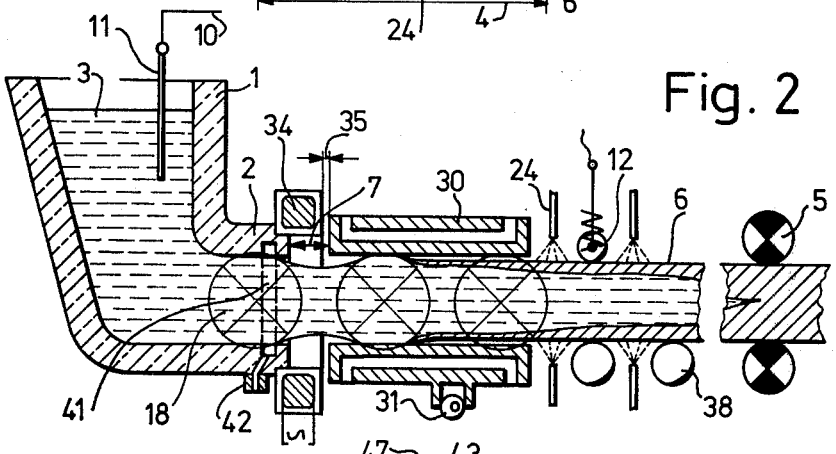
FIG. 2 is a longitudinal section through an embodiment of the invention which operates with a mold.

FIG. 2 illustrates an arrangement which includes a water-cooled mold 30 and an oscillating mechanism 31 therefor. In this figure, the same reference numerals as in FIG. 1 are used to identify similar elements. The pouring opening 2 extends into the space within a coil 34 which offsets the metallostatic pressure at least in a sub-zone 7 between the pouring opening 2 and the mold 30. The current and frequency are so adjusted that the molten metal is slightly constricted between the pouring spout 2 and the mold 30. The purpose of the constriction is to ensure that all of the molten metal enters the mold 30. A gap 35 is always present between the coil 34 and the mold 30. Compensation for the weight of the strand 6 between the pouring opening 2 and the mold 30 is carried out in the manner described for FIG. 1. Advantageously, this compensation is also carried out within the mold 30. This enables the strand 6 to move into the mold 30 concentrically so that gaps caused by shrinkage of the strand 6 are evenly distributed over its periphery thereby improving the quality of the strand 6. Supporting rollers 38 are arranged downstream of the mold 30.

Figure 3:
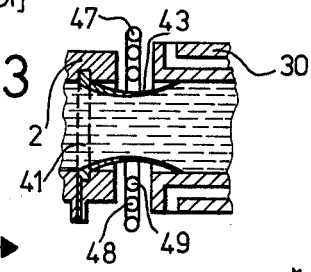
FIG. 3 is a longitudinal section through another embodiment of the invention.

A feeding device in the form of an annular groove 41 is provided in the inner wall of the pouring opening 2 and, advantageously, in the region of the zone 7 where the strand 6 is constricted. The groove 41 communicates with a pipe 42 for supplying a lubricant or a casting powder. A film 43 of lubricant or casting powder is illustrated in FIG. 3. The film 43 protects the metal between the pouring opening 2 and the mold 30 against contact with the atmosphere and lubricates the strand 6 in the mold 30. It is also possible to spray the abovementioned agents into the zone 7.

FIG. 3 illustrates another coil arrangement. Here, use is made of a three layer coil or of three concentric and approximately coplanar coils 47, 48 and 49. Such an arrangement produces an enhanced non-uniform force effect which is very advantageous for the shaping of the strand 6. It is also possible to use a number of rows of concentric coils arranged one behind the other in the direction of movement of the strand 6, and each of these can have a different frequency and/or a different phase.

Figure 4:
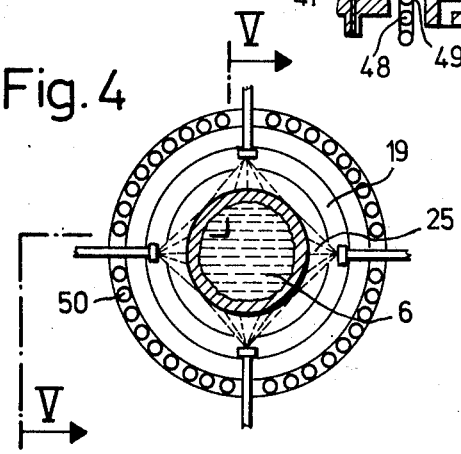
FIG. 4 is a vertical section through a coil arrangement according to the invention.
Figure 5:
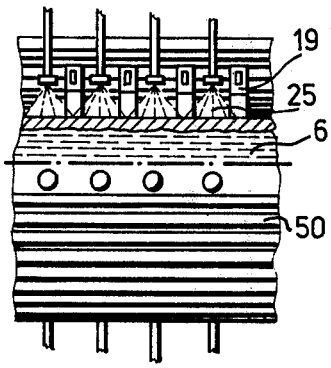
FIG. 5 is a view in the direction of the arrows V—V of FIG. 4.

Referring to FIGS. 4 and 5, the partially solidified strand 6 is surrounded by the coils 19 which are arranged coaxially therewith. The fan-shaped jets 25 cool the surface of the strand 6 in a uniform manner. The magnetic fields illustrated diagrammatically in FIGS. 1 and 2 and designated by the reference numeral 18 are produced by coils 50. The turns of the coils 50 extend parallel to the longitudinal axis of the strand 6. The coils 50 will generally consist of two shell-like halves. The boundary between two halves of a coil 50 is advantageously vertical. The strand 6 can be reached by horizontally displacing at least one of the halves of a coil 50.

The invention can be applied with particular advantage to the production of billets and blooms.

We claim:

1. A continuous casting method comprising the steps of:

(a) forming a substantially horizontal strand by admitting a stream from a body of molten metal into a substantially horizontal path;

(b) Conveying said strand along said path;

(c) Cooling said strand in an upstream portion of said path so as to progressively solidify the same, said strand being at least partially molten along said portion of said path;

(d) at least partially counteracting the weight of said strand in said portion of said path by causing an upwardly directed force to act on said strand, said upwardly directed force being created by passing an electrical current through said strand in longitudinal direction thereof and simultaneously generating in the latter a substantially horizontal magnetic field which is substantially normal to the longitudinal axis of said strand; and (e) at least partially counteracting the metallostatic pressure due to said body of molten metal by generating an alternating magnetic field around said strand in said portion of said path.

2. The method of claim 1, wherein said alternating magnetic field is generated in the region of the upstream end of said path.

3. The method of claim 1, wherein the progressive solidification of said strand is initiated in an oscillating mold.

4. The method of claim 3, wherein a lubricant is introduced between said strand and the wall of said mold.

5. The method of claim 3, wherein a casting powder is introduced between said strand and the wall of said mold.

6. A continuous casting apparatus comprising:

(a) a vessel means for accommodating a body of molten metal, said vessel means having an opening for the admission of a stream of molten metal into a substantially horizontal path so as to form a substantially horizontal strand therein;

(b) means for conveying the strand along said path, said path having an upstream portion along which the strand is in an at least partially molten condition;

(c) first counteracting means for at least partially counteracting the weight of the strand in said portion of said path, said first counteracting means including a first electrical contact arranged to extend into the body of molten metal in said vessel means, and a second electrical contact connected with said first electrical contact and arranged to engage the strand, said first counteracting means further including magnet means for generating in said portion of said path a substantially horizontal magnetic field which is substantially normal to the longitudinal direction of said path; and (d) second counteracting means for at least partially counteracting the metallostatic pressure due to the body of molten metal in said vessel means, said second counteracting means comprising at least one coil which surrounds said portion of said path and is arranged to induce an alternating magnetic field in the same.

7. The apparatus of claim 6, wherein said opening faces said path and is located adjacent the upstream end thereof, said coil being arranged adjacent said opening.

8. The apparatus of claim 6, wherein said magnet means comprises a plurality of magnets spaced along said portion of said path.

9. The apparatus of claim 6, wherein said second counteracting means comprises a plurality of coils arranged along and surrounding said portion of said path, each of said coils having a plurality of windings.

10. The apparatus of claim 6, said second counteracting means comprising a plurality of coils arranged along and surrounding said portion of said path; and wherein cooling devices are arranged between said coils.

11. The apparatus of claim 6, comprising a reciprocable mold downstream of said coil.

12. The apparatus of claim 11, comprising a conduit upstream of said mold for the introduction of a lubricant or a casting powder into said path.

13. The apparatus of claim 6, wherein said opening faces said path and has a cross-section approximating that of the strand.

* * * * *